United States Patent [19]

Salentine

[11] 4,431,552

[45] Feb. 14, 1984

[54] LUBRICANT COMPOSITION CONTAINING AN ALKALI-METAL BORATE AND A MIXTURE OF PHOSPHATES, MONOTHIOPHOSPHATES AND DITHIOPHOSPHATES IN A CRITICAL RATIO

[75] Inventor: Christopher G. Salentine, Mill Valley, Calif.

[73] Assignee: Chevron Research Company, San Francisco, Calif.

[21] Appl. No.: 444,751

[22] Filed: Nov. 26, 1982

[51] Int. Cl.[3] ..... C10M 1/48

[52] U.S. Cl. ..... 252/32.7 E; 252/46.6; 252/46.7

[58] Field of Search ..... 252/32.7 E, 46.6, 46.7

[56] References Cited

U.S. PATENT DOCUMENTS 2,916,449 12/1959 Vierk et al. ..... 252/32.7 E 3,997,454 12/1976 Adams ..... 252/32.7 E

*Primary Examiner*—Jacqueline V. Howard

*Attorney, Agent, or Firm*—D. A. Newell; J. M. Whitney; J. J. DeYoung

[57] ABSTRACT

Disclosed is an alkali-metal borate containing lubricant which also contains a phosphate, monothiophosphate and dithiophosphate in a critical ratio.

7 Claims, No Drawings

LUBRICANT COMPOSITION CONTAINING AN ALKALI-METAL BORATE AND A MIXTURE OF PHOSPHATES, MONOTHIOPHOSPHATES AND DITHIOPHOSPHATES IN A CRITICAL RATIO

BACKGROUND OF THE INVENTION

The invention relates to extreme pressure lubricating oils, particularly alkali-metal borate-containing lubricants. More particularly, the invention relates to the finding that alkali-metal borate lubricants are greatly improved by addition to the borate lubricants of a combination of phosphates (sulfur-free), monothiophosphates and dithiophosphates in a critical ratio.

Alkali-metal borate-containing lubricants are well known in the art for their usefulness as extreme pressure lubricating oils. See, for example, U.S. Pat. Nos. 3,313,727, 3,565,802, 3,819,521, 3,846,313, 3,853,772, 3,907,691, 3,912,639, 3,912,643, 3,912,644, 3,997,454, and 4,089,790.

These patents also teach that the antiwear and load-carrying properties of the lubricants can be improved through the use of phosphate additives, particularly the zinc dithiophosphates and amine salts of dithiophosphoric acid (U.S. Pat. Nos. 3,997,454 and 4,089,790).

It is one object of the present invention to provide an alkali-metal borate-containing lubricant having improved wear and load-carrying properties. The improved properties are obtained through the use of a critical ratio of phosphate, monothiophosphate and dithiophosphate additives.

SUMMARY OF THE INVENTION

It has been found that the addition of an effective amount of a mixture of (a) a non-sulfur-containing phosphate, (b) a monothiophosphate and (c) a dithiophosphate in the ratio of 0.90–1.10:0.90–1.10:0.47–0.67 to a lubricating oil containing an alkali-metal borate improves the wear properties of the lubricant.

DETAILED DESCRIPTION OF THE INVENTION

The lubricant composition comprises an oil of lubricating viscosity having dispersed therein a particulate hydrated alkali-metal borate and a mixture of: (a) a non-sulfur-containing phosphate, (b) a monothiophosphate, and (c) a dithiophosphate in the ratio of 0.90–1.10:0.90–1.10:0.47–0.67. It has been found that the above three phosphates interact in a synergistic manner to provide improved wear when they are combined in a critical ratio.

Each of the individual components of the lubricant of this invention are well known in the art.

THE ALKALI-METAL BORATES

The hydrated particulate alkali-metal borates are well known in the art and are available commercially. Representative patents disclosing suitable alkali metal borates and methods of manufacture include: U.S. Pat. Nos. 3,313,727; 3,819,521; 3,853,772; 3,997,601; 3,997,454; and 4,089,790, the entire disclosures of which are incorporated herein by reference.

The hydrated alkali-metal borates can be represented by the following formula:

$$M_2O.mB_2O_3.nH_2O$$

where M is an alkali metal of atomic number in the range 3 to 19, i.e., sodium, lithium, and potassium, m is a number from 2.5 to 4.5 (both whole and fractional), and n is a number from 1.0 to 4.8. Preferred are the hydrated potassium borates, particularly the hydrated potassium triborate microparticles having a boron-to-potassium ratio of about 2.5 to 4.5. The hydrated borate particles generally have a mean particle size of less than 1 micron.

The alkali-metal borate will generally comprise 0.1 to 60 weight percent of the lubricant, preferably 0.5 to 15 weight percent.

THE SULFUR-FREE PHOSPHATES

Typical non-sulfur-containing phosphates useful in the present invention are well known in the art and include the hydrocarbyl phosphates where the hydrocarbyl will contain 3 to 50 carbon atoms, preferably 6 to 20 carbon atoms. The hydrocarbyl may be aromatic or alicyclic or combinations thereof. Representative phosphates include:

tripropyl phosphate; tributyl phosphate; tripentyl phosphate; trioctyl phosphate; tridecyl phosphate; tridodecyl phosphate; butyl dihexyl phosphate; hexyl dioctyl phosphate; dibutyl octyl phosphate; tricyclohexyl phosphate; tri(4-methylcyclohexyl) phosphate; triphenyl phosphate; tricresyl phosphate; trixylyl phosphate; trinaphthyl phosphate; tri(ethylphenyl) phosphate; phenyl dicresyl phosphate; phenyl dixylyl phosphate; cresyl dixylyl phosphate; diphenyl cresyl phosphate; phenyl cresyl xylyl phosphate; phenyl di(ethylphenyl) phosphate; tricumyl phosphate; phenyl dicumyl phosphate; cresyl dicumyl phosphate; tri(3,5-isopropylphenyl) phosphate; methyl diphenyl phosphate; ethyl diphenyl phosphate; diethyl phenyl phosphate; butyl diphenyl phosphate; butyl dicresyl phosphate; dibutyl cresyl phosphate; dibutyl phenyl phosphate; octyl diphenyl phosphate; hexyl dicresyl phosphate; decyl diphenyl phosphate.

Preferred are oleylammonium dibutylphosphate, dodecylammonium dibutylphosphate, oleylammonium diethyl-hexyl-phosphate, dodecylammonium diethylhexylphosphate, dodecylammonium dihexylphosphate, and oleylammonium dihexylphosphate.

THE MONOTHIOPHOSPHATES

Typical monothiophosphates useful in the lubricant of the present invention are well known in the art and include the O,O-dihydrocarbyl-S-hydrocarbyl phosphorothioates and the O,O,O-trihydrocarbylphosphorothioates where the hydrocarbyl will contain 4 to 50 carbon atoms, preferably 6 to 20 and amine salts of the O,O-dihydrocarbylphosphorothioates. The hydrocarbyl may be aromatic or alicyclic or combinations thereof. Representative monothiophosphates include:

tributylphosphorothioate; tripentylphosphorothioate; triheptylphosphorothioate; trioctylphosphorothioate; tridecylphosphorothioate; tridodecylphosphorothioate; tripentadecylphosphorothioate; trioctadecylphosphorothioate; trieicosylphosphorothioate;

O,O-dibutyl-S-pentylphosphorothioate; O,O-dioctyl-S-heptylphosphorothioate; O,O-didecyl-S-octylphosphorothioate; O,O-didodecyl-S-decylphosphorothioate; O,O-dipentadecyl-S-dodecylphosphorothionate; O,O-dieicosyl-S-pentaphosphorothioate.

Preferred are oleylammonium O,O-butylthiophosphate, dodecylammonium O,O-dibutylthiophosphate, dodecylammonium O,O-dihexylthiophosphate, and oleylammonium O,O-dihexylthiophosphate.

THE DITHIOPHOSPHATES

Typical dithiophosphates useful in the lubricant of the present invention are well known in the art and include the amine salts of O,O- and O,S-dihydrocarbyl dithiophosphates wherein the hydrocarbyl portion will contain 4 to 50 carbon atoms, preferably 6 to 20 carbon atoms. The hydrocarbyl may be aliphatic, aromatic or alicyclic or combinations thereof.

Representative dihydrocarbyl dithiophosphate amine salts include the butyl amine salt of di-2-ethyl-1-hexyl dithiophosphate, the pentyl amine salt of diisoctyl dithiophosphate, the diethylene triamine salt of ditetrapropenylphenyl dithiophosphate and the ethylene diamine salt of di-4-methyl-2-pentyl dithiophosphate.

Preferred are oleylammonium dihexyldithiophosphate, dodecylammonium dihexyldithiophosphate, dodecylammonium dibutyldithiophosphate, oleylammonium dibutyldithiophosphate, oleylammonium diethylhexyldithiophosphate, and dodecylammonium diethylhexyldithiophosphate.

The Critical Ratio of the Three Phosphates

It has been surprisingly found that all three phosphates must be present in the lubricant in a critical ratio. The ratio of phosphates (sulfur free) to monothiophosphates to dithiophosphates must be in the range 0.90–1.10:0.90–1.10:0.47–0.67 and preferably in the range 0.95–1.05:0.95–1.05:0.52–0.62.

Most preferred is the combination of oleylammonium dibutylphosphate, oleylammonium dibutylthiophosphate and oleylammonium dihexyl-dithiophosphate, particularly in the ratio of 1.00:1.01:0.57.

The lubricant composition contains an effective amount of the mixture of the three phsophates to improve the wear properties of the alkali-metal borate containing lubricant. Generally, the lubricant will contain 0.01 to 5.0 weight percent of the oil soluble phosphates mixture and preferably 0.1 to 2.0 weight percent.

The lubricating oil to which the borates and the mixture of phosphorus-containing compound are added, can be any hydrocarbon-based lubricating oil or a synthetic base oil stock. The hydrocarbon lubricating oils may be derived from synthetic or natural sources and may be paraffinic, naphthenic or asphaltic base, or mixtures thereof. A variety of other additives can be present in lubricating oils of the present invention. These additives include antioxidants, viscosity index improvers, dispersants, rust inhibitors, foam inhibitors, corrosion inhibitors, other antiwear agents, and a variety of other well-known additives. Particularly preferred additional additives are the oil-soluble succinimides and oil-soluble alkali or alkaline earth metal sulfonates.

EXAMPLES

To 2-gallon samples of a base oil containing 8.7 weight percent of a potassium triborate dispersion, 1.0 weight percent of a diparaffin polysulfide, 0.5 weight percent zinc dialkyldithiophosphate, and 0.5 weight percent of a phenolic antioxidant were added various amounts of metal-free phosphates, monothiophosphates and dithiophosphates as shown in Table I. The mixtures of three phosphates were obtained from commercially available phosphate containing additives. Additive "A" is Hitec 320 (Edwin-Cooper) and consists of 62 weight percent of a sulfurized olefin mixture (non-active), 10.4 percent phosphates, 17.6 percent monothiophosphates, and 10 percent rust inhibitors, diluents, etc. The phosphates and monothiophosphates are present as the oleylamine salts. Additive "B" is Anglamol 99 (Lubrizol) and consists of 61 weight percent of a sulfurized olefin mixture (non-active), 13.2 percent phosphates, 6.3 percent monothiophosphate, 13.5 percent dithiophosphate, and about 6 percent rust inhibitors, diluents, etc. The phosphates and monothiophosphates are present as the oleyl and dodecyl amine salts. A series of tests were performed on each test sample composition to measure the extreme-pressure properties (Timken E.P. Test), wear (FZG Gear Test), and shock load protection (CRC L-42 Axle Test). The Timken Test is described in ASTM D-2782, which test procedure is incorporated herein by reference.

The FZG test measures the antiscuffing properties of oil for reduction gears, hypoid gears, automatic transmission gears and the like. A description of the FZG test and the meaning of the results is found in the article "Scuffing Tests on Gear Oils in the FZG Apparatus" by G. Niemann, H. Rettig and G. Lechner in ASLE Transactions, 4 71-86 (1961). Test procedure DIN 51354 was utilized which is discussed in Prufung von Schmierstoffen: Mechanische Prufung von Gebriebeolen in der FZG—Zahnrad—Verspannungs—Prufmaschine, Januar 1970. The data in Table I is the total weight loss after 13 stages at double speed.

The CRC (Coordinating Research Council) L-42 Axle Test is described in ASTM publication STP 512, Library of Congress Catalog Card No. 72-76614.

TABLE I

| Example | ADDITIVE Concentration % | Phosphate Content of Additive $PO_4$ | $PO_3S$ | $PO_2S_2$ | Timken OK Load lbs | FZG Wear mg | CRC L-42% Scoring |
|---|---|---|---|---|---|---|---|
| 1 | — | — | — | — | 80 | 28 | 25–35 |
| 2 | 0.75(A) | 37 | 63 | 0 | 50 | 28 | 15–20 |
| 3 | 1.5 (A) | 37 | 63 | 0 | 30 | 69 | — |
| 4 | 0.75(B) | 40 | 19 | 41 | 60 | 20 | 10–12 |
| 5 | 1.5(B) | 40 | 19 | 41 | — | 356 | — |
| 6 | 0.75(A) + 0.75(B) | 39 | 39 | 22 | 70 | 7 | 5–6 |

Comparison of Examples 1 and 2 indicates no effect in the FZG wear test, a worsening of the Timken load test, and a small reduction in the percent scoring in the CRC L-42 test with the addition of an additive containing only sulfur-free phosphates ($PO_4$) and monothiophosphates.

Comparison of Examples 1 and 3 indicates that the Timken load and the FZG wear test results are much worse with the addition of twice as much of an additive containing only sulfur-free phosphates and monothiophosphates.

Comparison of Examples 1 and 4 indicates a small improvement in the FZG test and a worsening of the Timken load with the addition of an additive containing all three phosphates but in the wrong proportions.

Comparison of Examples 1 and 5 indicates that the FZG results are much worse with an increase in concentration of a mixture containing all three phosphates.

Comparison of Examples 1, 3 and 5 with 6 indicates that the Timken load improves and the FZG wear improves when the ratio of the phosphates to monothiophosphates to dithiophosphates is 1.00:1:01:0.57.

Comparison of Examples 1, 2, 4 and 6 indicates that the percent scoring in the CRC L-42 Axle Test also dramatically improves when the ratio of phosphates to monothiophosphates to dithiophosphates is in the ratio of 1.00:1:01:0.57.

What is claimed is:

1. A lubricating composition comprising an oil of lubricating viscosity having dispersed therein a hydrated alkali-metal borate extreme pressure agent and an effective amount of a mixture of: (a) a non-sulfur-containing phosphate, (b) a monothiophosphate and (c) a dithiophosphate to improve the wear properties of the lubricant, said mixture of phosphate, monothiophosphate, and dithiophosphate being in the ratio of 0.90–1.10:0.90–1.10:0.47–0.67.

2. The lubricating composition of claim 1 wherein said ratio of phosphate to monothiophosphate to dithiophosphate is in the range 0.95–1.05:0.95–1.05:0.52–0.62.

3. The lubricating composition of claim 2 wherein said alkali-metal borate is an alkali-metal triborate.

4. The lubricating composition of claim 3 wherein said alkali-metal borate is a potassium triborate.

5. The lubricating composition of claim 4 wherein said non-sulfur-containing phosphate is oleylammonium dibutylphosphate said monothiophosphate is oleylammonium dibutylthiophosphate, and said dithiophosphate is oleylammonium dihexyldithiophosphate.

6. The lubricating composition of claim 5 wherein said ratio of phosphate to monothiophosphate to dithiophosphate is 1.00:1.01:0.57.

7. The lubricating composition of claim 1 wherein said lubricant contains 0.5 to 15 weight percent of said alkali metal borate and 0.1 to 2.0 weight percent of said mixture of phosphates, monothiophosphates, and dithiophosphates.

* * * * *